United States Patent [19]

Baker Mervyn R. et al.

[11] Patent Number: 4,926,967

[45] Date of Patent: May 22, 1990

[54] FOLDING LADDERS

[76] Inventors: Baker Mervyn R., 12 Bowen Close, Prestbury Cheltenham, Gloucestershire; Raymond J. Pearson, 4 The Orchard, Ham Road, Charlton Kings, Cheltenham, Gloucestershire; Roger Emsley, Woodpeckers, Ash Lane, Down Hatherley, Gloucestershire, all of England

[21] Appl. No.: 295,383

[22] Filed: Jan. 10, 1989

[30] Foreign Application Priority Data

Jul. 27, 1988 [GB] United Kingdom ..... 8817934

[51] Int. Cl.[5] ..... E06C 1/383; E06C 1/52

[52] U.S. Cl. ..... 182/164; 182/220; 182/228

[58] Field of Search ..... 182/163, 164, 178, 228, 182/46, 220

[56] References Cited

U.S. PATENT DOCUMENTS

| | | | |
|---|---|---|---|
| 303,884 | 8/1884 | Reisener . | |
| 308,179 | 11/1884 | Linnenbrink . | |
| 311,661 | 2/1885 | Joynt . | |
| 1,228,248 | 5/1917 | Rudd . | |
| 1,644,739 | 10/1927 | McCracken . | |
| 1,722,844 | 7/1929 | Faulkenberry . | |
| 2,529,112 | 11/1950 | Steele . | |
| 3,216,526 | 11/1965 | Cole . | |
| 3,554,318 | 1/1971 | Knight . | |
| 3,655,012 | 4/1972 | Hoffman et al. . | |
| 3,730,295 | 5/1973 | Deese . | |
| 3,811,151 | 5/1974 | Kuemmerlin . | |
| 3,997,027 | 12/1976 | Patterson | 182/178 |
| 4,050,257 | 9/1977 | Parks | 182/178 |
| 4,086,980 | 5/1978 | Shortes | 182/151 |
| 4,429,766 | 2/1984 | Alimbau Marques . | |
| 4,448,283 | 5/1984 | Marques . | |
| 4,457,391 | 7/1984 | Alimbau Marques . | |
| 4,493,392 | 1/1985 | Alimbau . | |
| 4,519,476 | 5/1985 | Alimbau Marques et al. . | |
| 4,574,918 | 3/1986 | Marques . | |

FOREIGN PATENT DOCUMENTS

| | | |
|---|---|---|
| 0158695 | 10/1985 | European Pat. Off. . |
| 1211973 | 3/1960 | France . |
| 1560599 | 3/1969 | France . |
| 2384100 | 10/1978 | France . |
| 433724 | 8/1935 | United Kingdom . |

*Primary Examiner*—Reinaldo P. Machado
*Attorney, Agent, or Firm*—Young & Thompson

[57] ABSTRACT

A folding ladder comprises a series of modules, each module including a pair of spaced, parallel stile sections connected together by a transverse tread section. The modules are of decreasing size and each module, except for the largest one, is pivotally mounted between the stile sections of the next adjacent larger module, so that it can be folded from an extended position to a folded position in which the smaller module is nested within the larger module, releasable bolts being provided to lock the modules in the extended position. The tread and stile sections are hollow, and are connected together by separately formed joint members, one end of each joint member being secured within the hollow stile section, and the other end being secured within the hollow tread section.

10 Claims, 2 Drawing Sheets

FOLDING LADDERS

BACKGROUND OF THE INVENTION

The invention relates to folding ladders of the kind comprising a series of modules, each module including a pair of spaced, parallel stile sections connected together by a transverse tread section, the modules being of decreasing size and each module, except for the largest one, being pivotally mounted between the stile sections of the adjacent larger module, so as to be foldable between an extended position and a folded position in which the smaller module is nested within the larger module, releasable locking means being provided to lock each module in the extended position.

This provides a ladder which, when folded, is very compact in shape since the modules nest one within another so that the overall size of the folded ladder is little greater than the size of the largest module.

While arrangements are known in which the tread sections are bolted to the stile sections, it has usually been considered necessary to connect the tread sections to the stile sections by welding in order to provide the necessary strength and rigidity which a ladder, and particularly a folding ladder, must have. Accordingly, existing folding ladders of this kind have usually been made of steel, in order to permit such welding. This has the disadvantage that manufacture of each module is time-consuming and requires operator skill, as well as the use of welding equipment. Also, since the sections are made of steel, they are comparatively heavy and expensive to produce.

It is the object of the invention to provide a folding ladder which is strong and rigid, but which is light in weight and simple and inexpensive to manufacture.

According to the invention, a folding ladder of the kind first referred to is characterised in that the tread and stile sections are hollow, and in that the transverse tread section of each module is connected to each of its associated stile sections by a separately formed joint member, one end of which projects into the hollow stile section and is secured thereto, and the other end of which projects into the hollow tread section and is secured thereto.

Preferably, each hollow stile section is formed, in one side wall thereof, with an aperture so shaped that one end of the joint member projects through the aperture and into the interior of the stile section. The end of the joint member which projects into the interior of the hollow stile section may engage the side wall of the stile section which is opposite the aperture, and may be secured thereto by fasteners which pass through said opposite side wall and engage with the joint member.

Said other end of the joint member may project axially into the open end of the hollow tread section, and may be an interference fit thereon. It may be secured within the open end of the hollow tread section by fasteners which pass through a side wall of the tread section and engage with the joint member.

The releasable locking means associated with each module may include a bolt which is slideable within a passage in each joint member, the passage being in register with an aperture in the outwardly facing side wall of the stile section to which the joint member is secured so that the end of the bolt may project through said aperture, the inwardly facing side wall of the adjacent stile section on the adjacent larger module being formed with an aperture shaped and positioned to receive the projecting end of the bolt when the two modules are in the extended position, thereby to retain the modules in the extended position. Preferably, spring means are provided to urge the bolt normally into its projecting position. The spring means may, for example, comprise a helical compression spring encircling the bolt within the passage in the joint member and disposed between abutments on the bolt and joint member respectively.

Each bolt may be connected by a link to a manipulating member which is slideable in a slot in a side wall of the tread section, whereby the bolt may be retracted by sliding the manipulating member along the slot, each tread section being provided with two such bolts and manipulating members, and the manipulating members being located adjacent one another so that they may be operated simultaneously to retract both bolts.

DETAILED DESCRIPTION OF THE PREFERRED EMBODIMENTS

Figure 1:
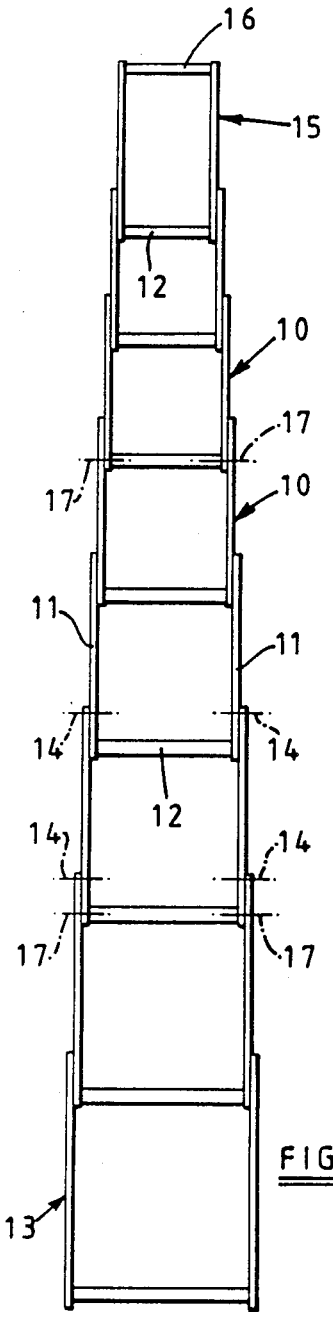
FIG. 1 is a diagrammatic view of a folding ladder of the basic kind to which the present invention relates, shown in the extended position.

Referring to FIG. 1, the ladder comprises a series of generally U-shaped modules 10 each of which comprises a pair of spaced, parallel stile sections 11 connected together by a transverse tread section 12. The modules are of decreasing size and each module, except for the largest lowermost module 13 is pivotally mounted between the stile sections of the adjacent larger and lower module by means of pivot pins, as indicated diagrammatically at 14. The smallest and uppermost module 15 is rectangular, being provided with an upper crosspiece 16 in addition to the tread section 12.

In order to maintain the ladder in the extended condition shown in FIG. 1, a locking mechanism is provided to lock each module to the stile sections of the adjacent lower module at a location spaced from the pivot pins 14. For example, the locking mechanism may be located at the junction between the tread section 12 and each stile section 11. One form of locking mechanism comprises two retractable bolts, usually spring loaded, which project outwardly at opposite ends of the tread section 12 and are engageable with inwardly facing holes in the stile sections of the embracing module. The positions of such bolts are indicated at 17 in FIG. 1

In order to fold the ladder, the bolts are retracted and each module 10 is folded about the pivot pins 14 so as to lie within the adjacent larger module. All the modules may thus be nested so that, when the ladder is fully folded, all the other modules 10 lie substantially within the largest module 13.

As previously mentioned, is most existing ladders of this type the stile sections 11 and tread sections 12 are formed from tubular steel, for example of box section, and the ends of the tread section are welded to the stile sections. This provides a rigid assembly but results in a ladder which is heavy and costly to manufacture.

Figure 2:
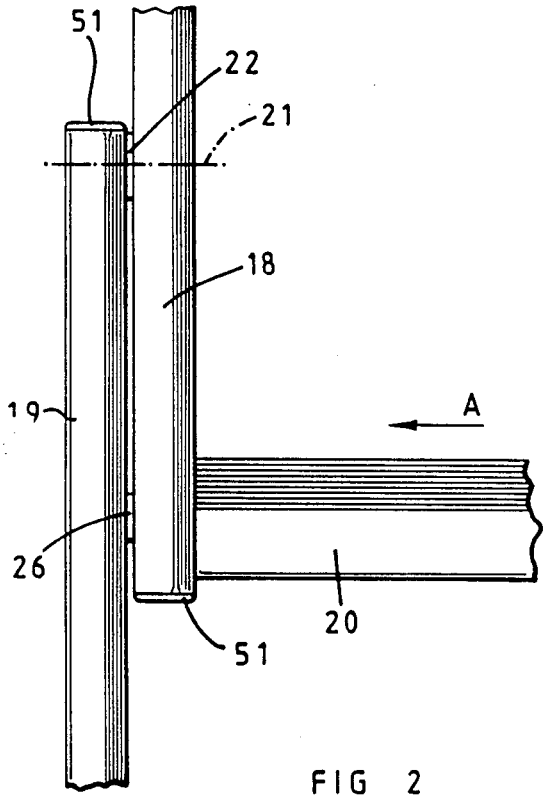
FIG. 2 is a view, on an enlarged scale, of the connection between two modules in a folding ladder according to the invention.
Figure 4:
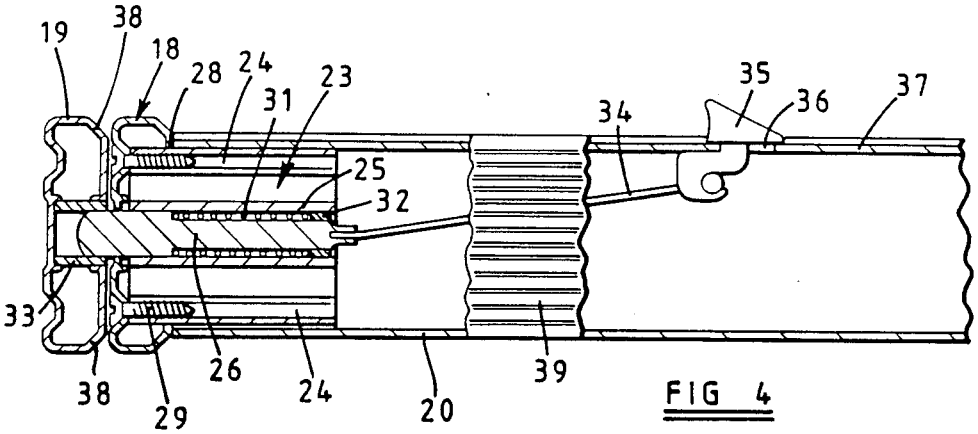
FIG. 4 is a section along the line 4—4 of FIG. 3.
Figure 3:
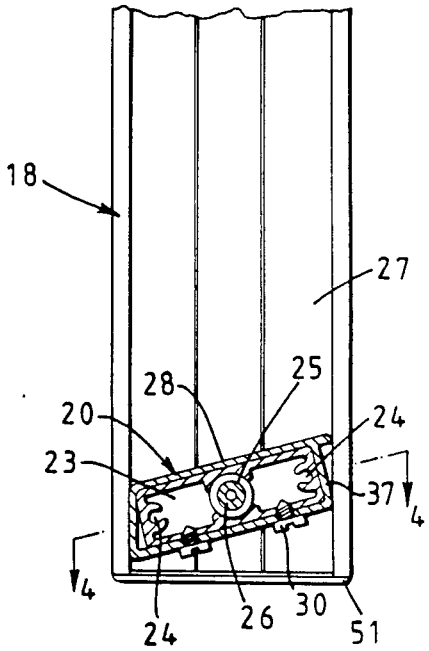
FIG. 3 is a view looking in the direction of arrow A of FIG. 2.

FIG. 2–4 of the drawings illustrate a preferred form of folding ladder according the present invention in which the stile sections 18, 19 and tread sections 20 are extruded from aluminium and are thus light in weight as well as being comparatively cheap to manufacture to any required cross-section.

Referring to FIG. 2, the tread section 20 is secured to the lower end of each inner stile section 18, in a manner to be described, and the inner stile section is pivotally connected within the upper end of an outer stile section 19 on a pivot axis indicated at 21, by means of a pivot pin or bolt (not shown). A washer 22 is provided between the two stile sections to prevent them binding.

The method of rigidly securing the tread section to the stile sections, as well as the associated locking device, is shown in greater detail in FIGS. 3 and 4.

A joint member 23 is an interference fit into each end of the hollow aluminium tread section 20. As best seen in FIG. 3, the joint member 23, which may be a length of aluminium extrusion, is generally rectangular in section and hollow, but is formed internally along each narrow longitudinal edge thereof with screw channels 24. Received between bearing surfaces within the joint member 23 is a longitudinally extending bearing tube 25 which may be formed of any suitable material such as aluminium, plastics or steel. A locking bolt 26 is slideable within the tube 25.

The inwardly facing side wall 27 of the stile section 18 is formed with an aperture 28 which is of the same shape as the cross-section of the joint member 23 so that one end of the joint member, which projects from the end of the tread section 20, may pass tightly through the aperture 28, as best seen in FIG. 4, and engage the inner surface of the outer side wall of the stile section 18, where it is secured by self-tapping screws 29 which engage the screw channels 24. The end surface abuts the surface of the stile section when the projecting portion of the joint member is fully received within the stile section.

The portion of the joint member 23 which extends into the open end of the hollow tread section 20 is secured thereto by further self-tapping screws 30 which pass through the lower side wall of the tread section 20.

The joint member 23 thus provides a very strong and rigid, but easily fitted, connection between the tread section 20 of each module and its associated stile sections.

The locking bolt 26 which is slideable in the tubular member 25 in each joint member has a reduced diameter portion which is encircled by a helical compression spring 31 which is disposed between a shoulder on the bolt 26 and an annular abutment 32 within the inner end of the tube 25. The compression spring 31 thus serves to urge the bolt 26 outwardly to the normal extended position shown in FIG. 4 where the end of the bolt projects through an aperture in the outer side wall of the stile section 18 which is in register with the end of the tube 25.

In the extended position of the ladder, as shown in FIGS. 1, 2 and 3, the end of the bolt 26 passes through a registering aperture in the inwardly facing side wall of the outer stile section 19 and into a short tubular bearing 33 secured within the hollow section in register with the aperture. Alternatively, the tubular bearing 33 may be omitted and the projecting end of the bolt 26 may pass into a simple correspondingly sized hole in the inwardly facing wall of the outer stile section 19. Engagement of the bolt 26 with the stile section 19 maintains the two modules of the ladder rigidly in the extended position.

For the purpose of retracting each bolt 26, a link rod 34 is provided connecting the inner end of the bolt 26 to a manipulating member 35 which is slideable in a slot 36 in the rear surface 37 (see FIG. 3) of the tread section 20. Sliding movement of the manipulating member 35 towards the centre of the tread section 20 withdraws the bolt 26, against the action of the spring 31, freeing the two stile sections 18 and 19 so that the inner module may be pivoted to the folded position where it is nested within the larger module.

A similar joint member and bolt assembly is provided at the opposite end of each tread section 20 and the two manipulating members 35 are located near each other on either side of the centre of the tread section so that by squeezing the two manipulating members 35 towards one another the two bolts at opposite ends of the tread section may be withdrawn simultaneously.

To erect the ladder, each module in turn is unfolded from its adjacent larger module in turn and into the position shown in FIGS. 1 and 2. In order to permit entry of the bolts 26 into the apertures in the outer stile sections, it may be necessary temporarily to withdraw each bolt by operation of the manipulating members 35, releasing the manipulating members when the associated module is in the extended position so that the bolts 26 can snap into engagement with the apertures in the adjacent stile sections. Alternatively, the profiles of the stile sections may be so shaped that the bolts 26 may automatically snap into engagement with the stile sections, without the necessity of positively withdrawing the bolts. For example, the inclined edge portions 38 of the stile sections may be shaped to co-operate with the rounded ends of the bolts so as to force the bolts back into the joint members 23 as the inner module is swung across the inwardly facing surface of the outer module.

As best seen in FIG. 3, each tread section 20, as viewed in section, is inclined at an angle of greater than 90° to the longitudinal axes of the stile sections 18 so that when the ladder is leaned at an angle against a wall, for example, the upper surfaces of the tread sections can be substantially horizontal for added security of the user. The upper surface of each tread section is ribbed as indicated at 39 in FIG. 4.

In any of the arrangements described above, the open ends of the stile sections such as 18 and 19 are closed by plastics plugs such as are indicated at 51 in FIGS. 2 and 3.

Figure 5:
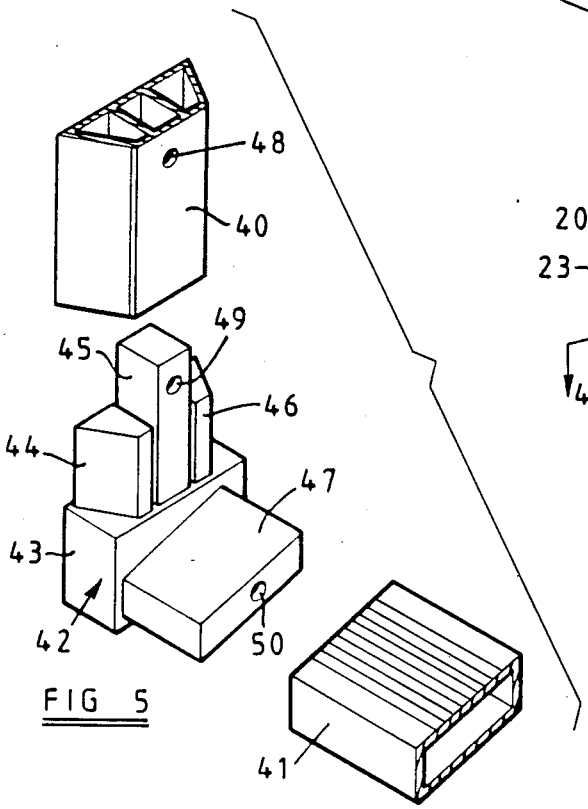
FIG. 5 is an exploded perspective view of an alternative arrangement in accordance with the invention.

In the alternative arrangement shown in FIG. 5 the stile sections 40 are again formed of aluminium extrusions, and have a hollow trapezoidal cross-section. The trapezoidal section has a pair of parallel inner and outer faces of which the outer face is the wider, and these are joined by two inclined faces extending at angles of approximately 60°. Within the section are two integral reinforcing ribs. The tread section 41 is of generally rectangular hollow tubular form.

To connect each stile section 40 with the tread section 41 there are provided two joint member one of which is indicated at 42 in FIG. 5. Each joint member is produced from plastics by injection moulding or other suitable process. The two joint members at opposite ends of the tread section are similar but of opposite hand. Each joint member comprises a corner block 43 from which extend upwardly integral spigots 44, 45 and 46 which together make up a trapezoidal configuration and are arranged to engage in the lower end of the stile section 40. The spigots 44, 45, 46 are slightly tapered so that the stile section engages with an interference fit onto the spigots. From the corner block 43 extends a further spigot 47 which is directed transversely with respect to the lengths of the spigots 44, 45, 46. The spigot 47 is angled to the surface of the corner block 43 on which the lower end of the stile section 40 abuts. The spigot 47 enters the end of the tread section 41 and is also slightly tapered so as to provide an interference fit therein.

The tread section 41 extends perpendicularly to the stile section 40, but the angle at which it is set is so chosen that when the ladder is erected and leaned at a suitable angle for use, the upper surfaces of the treads are substantially horizontal and parallel with the floor on which the ladder is standing.

Hinge pins (not shown) pass through holes 48 in the stile sections 40 and also through respective aligned holes 49 in the associated spigot 45 of the joint member 42. The hole 49 in the spigot 45 is slightly smaller than that in the stile section so that the hinge pin engages in the plastics or other material of the spigot 45 rather than in the metal of the stile section.

To lock the ladder sections in the erect position, there is provided a locking mechanism similar to that shown in the embodiments of FIGS. 2–4. In the FIG. 5 arrangement, the locking bolt, corresponding to the bolt 26 shown in FIG. 4, passes through a bore 50 through the spigot 47 and block 43. The bore 50 is internally stepped to provide the housing for the helical compression spring.

It is possible for the ladder according to the invention to be used as a set of steps by releasing one of the locking mechanisms in a mid-region of the erected ladder. A brace, or other means, not shown, is used to hold the two portions of the ladder at either side of the hinge at which the released locking mechanism is situated. This enables the two portions of the ladder to be maintained at a predetermined angle to one another.

Clips or straps may be used to secure all the sections together when in the fully folded condition of the ladder, so that the whole assembly is conveniently held together to make it easily portable.

We claim:

1. A folding ladder comprising a series of modules, each module including a pair of spaced, parallel stile sections connected together by a transverse tread section, the modules being of decreasing size and each module, except for the largest one, being pivotally mounted between the stile sections of the next adjacent larger module, so as to be foldable between an extended position and a folded position in which the smaller module is nested within the larger module, releasable locking means being provided to lock each module in the extended position, characterised in that the tread and stile sections are hollow, and in that the transverse tread section of each module is connected to each of its associated stile sections by a separately formed joint member, one end of which projects into the hollow stile section and is secured thereto, and the other end of which projects into the hollow tread section and is secured thereto.

2. A folding ladder according to claim 1, wherein each hollow stile section is formed, in one side wall thereof, with an aperture so shaped that one end of the joint member projects through the aperture and into the interior of the stile section.

3. A folding ladder according to claim 2, wherein the end of the joint member which projects into the interior of the hollow stile section engages the side wall of the stile section which is opposite the aperture, and is secured thereto by fasteners which pass through said opposite side wall and engage with the joint member.

4. A folding ladder according to claim 1, wherein said other end of the joint member projects axially into the open end of the hollow tread section.

5. A folding ladder according to claim 4, wherein said other end of the joint member is an interference fit within the open end of the hollow tread section.

6. A folding ladder according to claim 4, wherein said other end of the joint member is secured within the open end of the hollow tread section by fasteners which pass through a side wall of the tread section and engage with the joint member.

7. A folding ladder according to claim 1, wherein the releasable locking means associated with each module includes a bolt which is slideable within a passage in each joint member, the passage being in register with an aperture in the outwardly facing side wall of the stile section to which the joint member is secured so that the end of the bolt may project through said aperture, the inwardly facing side wall of the adjacent stile section on the adjacent larger module being formed with an aperture shaped and positioned to receive the projecting end of the bolt when the two modules are in the extended position, thereby to retain the modules in the extended position.

8. A folding ladder according to claim 7, wherein spring means are provided to urge the bolt normally into its projecting position.

9. A folding ladder according to claim 8, wherein the spring means comprise a helical compression spring encircling the bolt within the passage in the joint member and disposed between abutments on the bolt and joint member respectively.

10. A folding ladder according to claim 7, wherein each bolt is connected by a link to a manipulating member which is slideable in a slot in a side wall of the tread section, whereby the bolt may be retracted by sliding the manipulating member along the slot, each tread section being provided with two such bolts and manipulating members, and the manipulating members being located adjacent one another so that they may be operated simultaneously to retract both bolts.

* * * * *

UNITED STATES PATENT AND TRADEMARK OFFICE

CERTIFICATE OF CORRECTION

PATENT NO. : 4,926,967

DATED : May 22, 1990

INVENTOR(S) : Mervyn Reginald Eli BAKER et al.

It is certified that error appears in the above—identified patent and that said Letters Patent is hereby corrected as shown below:

In the surname of the inventors, in Item 19, change "Baker Mervyn R. et al." to --Baker et al.--.

In Item 76, change the name of the first inventor, from "Baker Mervyn R.," to --Mervyn R. E. Baker,--.

Signed and Sealed this

Twentieth Day of August, 1991

*Attest:*

*Attesting Officer*

HARRY F. MANBECK, JR.

*Commissioner of Patents and Trademarks*